US012251005B2

(12) United States Patent
Nilsen

(10) Patent No.: US 12,251,005 B2
(45) Date of Patent: Mar. 18, 2025

(54) HAIRDRESSING APPARATUS

(71) Applicant: KAN Holding AS, Oslo (NO)

(72) Inventor: Kare A. Nilsen, Hosle (NO)

(73) Assignee: KAN Holding AS, Oslo (NO)

( * ) Notice: Subject to any disclaimer, the term of this patent is extended or adjusted under 35 U.S.C. 154(b) by 1069 days.

(21) Appl. No.: 16/969,571

(22) PCT Filed: Feb. 20, 2019

(86) PCT No.: PCT/EP2019/054206
§ 371 (c)(1),
(2) Date: Aug. 13, 2020

(87) PCT Pub. No.: WO2019/162322
PCT Pub. Date: Aug. 29, 2019

(65) Prior Publication Data

US 2021/0007458 A1 Jan. 14, 2021

(30) Foreign Application Priority Data

Feb. 23, 2018 (EP) ..... 18158391

(51) Int. Cl.
*A45D 20/50* (2006.01)
*A45D 20/12* (2006.01)
(Continued)

(52) U.S. Cl.
CPC ..... *A45D 20/50* (2013.01); *A45D 20/122* (2013.01); *A45D 20/525* (2013.01); *A45D 24/10* (2013.01)

(58) Field of Classification Search
CPC ..... A45D 24/00; A45D 24/10; A45D 24/22; A45D 20/04; A45D 20/06; A45D 20/50;
(Continued)

(56) References Cited

U.S. PATENT DOCUMENTS 4,209,685 A * 6/1980 Walter ..... A45D 1/04 132/118
5,261,427 A 11/1993 Dolev
(Continued)

FOREIGN PATENT DOCUMENTS

CN 1146883 4/1997
CN 101212915 7/2008
(Continued)

OTHER PUBLICATIONS

Clarivate Analytics copywritten translation of WO2006/103740, International filing date Mar. 28, 2005 (Year: 2005).*
(Continued)

*Primary Examiner* — Jacqueline T Johanas
*Assistant Examiner* — Sarah Woodhouse
(74) *Attorney, Agent, or Firm* — Christian D. Abel

(57) ABSTRACT

Hairdressing device (1) for shaping hair, comprising a holder (2) arranged with an air distribution chamber (3) and arranged with a plurality of teeth projecting from the holder (2), the plurality of teeth comprises combing teeth (20) and hollow teeth (50, 5) wherein each hollow tooth (50) comprises a channel (51) with at least one outlet opening (52, 52*a*, 52*b*) for the air to flow from the air distribution chamber (3) and exit through the at least one outlet opening (52, 52*a*, 52*b*). The hollow teeth (50) and the combing teeth (20) are positioned in an alternating pattern (10) where a hollow tooth is placed next to a combing tooth, and the hollow teeth (50) is configured for the air to flow out from outlet openings (52) at opposite sides (AB) of a central longitudinal plane through the holder (2).

8 Claims, 4 Drawing Sheets

(51) Int. Cl.
*A45D 20/52* (2006.01)
*A45D 24/10* (2006.01)

(58) Field of Classification Search
CPC .... A45D 20/12; A45D 20/122; A45D 20/124; A45D 20/48; A45D 20/52; A45D 20/525; A45D 2/36; A45D 4/10; A45D 20/08; A45D 20/10; A46B 9/025; A46B 9/023; A46B 2200/104; A46B 9/06; A46B 9/005; A46B 9/02; A46B 9/028; A46B 9/00; A46B 2200/102; A46B 2200/1026; A46B 5/0095; A46D 1/02; A46D 1/0246; A46D 1/0269
USPC ..... D28/7, 20–34; 15/110, 186, 227
See application file for complete search history.

(56) References Cited

U.S. PATENT DOCUMENTS

| | | | | | |
|---|---|---|---|---|---|
| 5,657,775 | A * | 8/1997 | Chou | A46B 9/023 | 15/207.2 |
| 5,803,093 | A * | 9/1998 | Romano | A45D 24/22 | 132/114 |
| 6,260,557 | B1 * | 7/2001 | Yarbrough | A45D 24/22 | 132/114 |
| 2002/0096184 | A1 * | 7/2002 | Elmer | A45D 24/22 | 132/114 |

FOREIGN PATENT DOCUMENTS

| | | | | |
|---|---|---|---|---|
| CN | 203121410 | | 8/2013 | |
| CN | 106455785 | | 2/2017 | |
| DE | 29515923 | | 12/1995 | |
| FR | 2785159 | A1 * | 5/2000 | A45D 2/002 |
| JP | 2004313588 | | 11/2004 | |
| WO | WO-9827844 | A1 * | 7/1998 | A45D 20/50 |
| WO | WO 2006/103740 | | 10/2006 | |

OTHER PUBLICATIONS

Clarivate Analytics copywritten translation of JP2004033274A, publication date Feb. 5, 2004 (Year: 2005).*
Clarivate Analytics copywritten translation of JP3688406B2, publication date Aug. 31, 2005 (Year: 2005).*
Clarivate Analytics copywritten translation of FR2785159A1, publication date May 5, 2000 (Year: 2000).*
Clarivate Analytics copywritten translation of FR2916945A1, publication date Dec. 12, 2008 (Year: 2008).*
Clarivate Analytics copywritten translations of WO2007003795, publication date Jan. 11, 2007 (Year: 2007).*
Clarivate Analytics copywritten translations of FR2933852, publication date Jan. 22, 2010 (Year: 2010).*
Clarivate Analytics copywritten translation of KR998166b1, publication date Dec. 3, 2010 (Year: 2010).*
Clarivate Analytics copywritten translation of FR2919176, publication date Jan. 30, 2009 (Year: 2009).*
Clarivate Analytics copywritten translation of KR2010003118U, publication date Mar. 18, 2010 (Year: 2010).*
Clarivate Analytics copywritten translation of WO2014/088157, international filing date Mar. 7, 2013 (Year: 2013).*
Clarivate Analytics copywritten translation of JP4296841B2, publication date Jul. 15, 2009 (Year: 2009).*
Clarivate Analytics copywritten translation WO2007003796, publication date Jan. 11, 2007 (Year: 2007).*
Clarivate Analytics copywritten translation of KR20070064709A, Jun. 22, 2007 (Year: 2007).*

* cited by examiner

D-D

E-E

F-F

HAIRDRESSING APPARATUS

The present invention concerns a hairdressing device. More specifically, a hairdressing apparatus is disclosed, for concurrent combing and drying of hair.

BACKGROUND

After a hair washing, or other wetting of hair, the strands of hair tends to stabilize with a certain elastic rigidity in the form and position they assume during drying. During hairdressing, when air is supplied, and, specifically when hot air is supplied, e.g., with a so-called blow-dryer, it is thus important to get the strands of hair into a desired form and position during the drying procedure. More specifically, in the dressing of relatively short hairstyles, such as a typical male hairdo or a short hair female hairdo, it is important, during the drying, that the hairs do not lay flat against the scalp, but rather are raised in an arc in the direction of dressing the hair, such that it is possible to create relatively tall hair styles having an attractively full appearance. Usually, this is achieved when the hair dresser leads the blow-dryer slowly across the head with one hand, and, at the same time, the other hand lifts the hair in front of the air flow using a comb, which, however, is something that requires a lot of practice and a steady hand to produce a desired result.

However, it is already known to perform combing and supplying of hot air in one operation using some sort of brush having hollow teeth attached to a hot air distributing chamber which is designed as a handle, and wherein the air is blown towards the hair during combing.

DE 2 137 407 discloses a known embodiment in which the teeth are designed as hollow tubes through which the air flows from a distributing chamber towards openings close to the tips of the teeth, and, wherein the distribution chamber between the teeth have additional openings, from which the air is blown directly down toward the hair and scalp. The side openings partly face one side, and partly the other side, relative the longitudinal axis of the brush. The result is that the air is blown partly directly down toward the hair, and partly with an inclination toward the scalp in different directions. The sideways directed outlet openings in the teeth will produce a direct drying action at the root of the hair strands. The component of the air streams directed down toward the scalp will however cause the hair to lay down flat, such that stabilization by direct drying action will be performed on strands of hair which lay flat. And, because the air must deflect along the scalp, the drying action occurs along the top of the hair strands because of the specific holes in the distributor, and the blowing action occurs straight down, which further contributes to flatten the hair strands. Said stabilization action is thus irregular because of the different orientation of the air streams from the teeth. Consequently, with such apparatuses, it is difficult to achieve results as good as those achieved by an experienced hair dresser concurrently using a comb and a blow-dryer.

Applicant's own patent NO 135966 was directed to solve this problem by making it possible, in a convenient way, to achieve good results in an operation using only one hand. The apparatus disclosed in said patent has teeth attached to a hollow grip which works as a hot air distribution chamber, for concurrent combing and drying, and the teeth are constituted by hollow tubes which are joined to the distribution chamber. The apparatus is characterized in that the end parts of the teeth are all curved in the same direction and have outlet openings which are directed backwards with an inclination.

This apparatus provides a substantial improvement. However, it has disadvantages which limit the combing effect, because the tips of the teeth are curved, and they must have a certain width to allow air to flow out from the tip of a tooth. Another disadvantage when hot air is supplied is that the scalp may quickly heat up, with discomforting results.

A further application owned by the applicant WO2015162209 describes a hair dresser apparatus for improved combing and drying effect where inclined air outlet openings arranged at the tip of curved hollow teeth ensures that the air is directed away from the scalp and towards the hair. When using this apparatus, air is supplied from one side of the hollow teeth and this makes drying and shaping in some of combing directions rather cumbersome and may involve awkward hand-held positions for achieving a satisfactory result.

The hairdressing device in accordance with the present invention alleviates the disadvantages of the prior art solutions and provides an improved combing and blow-drying effect. The hairdressing device may be easily used in all hand holding positions and combing direction without awkward hand positions or the need for readjusting of the hair dressing device.

When using the hairdressing apparatus while the brush is pulled through wet hair, hot air will be supplied in the combing direction and quickly dry shape the bottom part of the hair strands, and at the same time, avoiding the danger of heating up the scalp itself. The hairdressing apparatus will also contribute to raise the hair strands such that they are stabilized in a desired position. The result is that one achieves a dried hair with a full look, and wherein one is free to give shape to a desired hairdo and decide the direction of the hair when in the dried condition.

Following performance of a combined combing and drying operation, the final hairdressing work may be carried out, without risking the strands of hair losing their resilience, and desirably during continued use of the hairdressing apparatus as a common hair brush. Using the combined combing, drying and airing action, the present hairdressing apparatus achieves a stabilization of the strands of hair in a desired shape and position irrespective of the prior positioning of the hair, that is, if the hair for instance is laying in, against, or is differently oriented in relation to the direction of combing.

SUMMARY OF THE INVENTION

In accordance with the independent claim the invention concerns a hairdressing device for shaping hair comprising a holder arranged with an air distribution chamber. The holder is further arranged with a plurality of teeth projecting therefrom. The plurality of teeth comprises combing teeth and hollow teeth. Each hollow tooth comprises a channel with at least one outlet opening for the air to flow from the air distribution chamber and exit through the at least one outlet opening. The hollow teeth and the combing teeth are positioned in an alternating pattern where a hollow tooth is placed next to a combing tooth, and the hollow teeth are configured for the air to flow out from the outlet openings at opposite sides A, B of a central longitudinal plane L through the holder.

The combination of hollow teeth and the combing teeth in an alternating pattern is advantageous for achieving an optimized combing and blow-drying effect. The presence of narrow combing teeth provides for a satisfactory combing effect, while hollow teeth produce a sufficient blow-drying effect. The arrangement of the outlet openings for supplying an air flow at both sides of the hairdressing device, namely towards opposite sides A, B of the central longitudinal plane through the holder, allows for a versatile use where the hairdressing device may easily be applied in various hand-held positions and for all hair forming and combing directions. The hairdressing device may as well be applied equally by left and right-handed users.

In an advantageous embodiment, the hollow teeth are positioned in an alternating pattern where every other of hollow teeth are configured for the outlet openings to exit the air flow at one side of the central longitudinal plane L, and the remaining hollow teeth are configured for the outlet openings to exit the air flow at other side of the central longitudinal plane L. By this arrangement the outlet openings of every other hollow teeth may be oriented opposed facing towards either side of the central longitudinal plane L. This orientation of the channel and the outlet opening ensures an equal distribution of air flow at both sides of the hairdressing device.

The channels may have a portion that is curved and may display a J-configuration with the outlet opening positioned at the tip of the J, when viewed in a lengthwise cross section of the hollow teeth. When arranged in an alternating pattern, neighbouring channels then display mirrored J-configurations.

As an alternative to organizing the hollow and combing teeth in an alternating pattern, at least one of the channels of the hollow teeth may be configured with two outlet openings, namely a first outlet opening and a second outlet opening. The channel may then receive the air flow from the air distribution chamber and divert the air flow out through the first and second outlet opening. The first opening and the second opening may be arranged to face opposite sides opposite sides A, B of the central longitudinal plane L for letting the air flow to these opposite sides A, B.

At least one of the outlet openings of the hollow teeth may have an inclined orientation, positioning at least part of the plane of the outlet opening at a predetermined acute angle with the central longitudinal plane. By this orientation, the air flow exiting the outlet openings is to be directed away from the hair scalp, protecting the scalp from the heat of the air flow, aiming the air flow at the hair strand to be dried and formed. The angle of the outlet openings may be uniform or may vary amongst the hollow teeth when moving along the central longitudinal plane. This aspect is applicable both for the channel having one and two outlet openings.

In order to optimize the combing effect of the hairdressing device, the hollow tooth may be configured with an exterior combing structure. The exterior combing structure may be positioned at both sides of the central longitudinal plane L and may have a configuration surrounding the channel. The outer contour of the exterior combing structure may be sized to correspond with the outer contour of combing teeth to ensure that the hairdressing device has a uniform combing section.

The exterior combing structure may have a position at a lateral distance from the central longitudinal plane which corresponds to the lateral distance of the combing teeth, thus providing the hollow and combing teeth with an essentially uniform cross-sectional area when moving in direction of the central longitudinal plane L which surrounds the channel. The exterior combing structure extends at both sides of the central longitudinal plane L.

Each combing tooth may comprise a pair of two tooth sections each distanced at an essentially equal lateral distance from the central longitudinal plane. The combing tooth may of course constitute more than two teeth sections or may be made by other shapes than a tooth section, such as for instance a lateral dividing element where the lateral extension is varied.

The combing tooth may have an inclined orientation relative to the central longitudinal plane. The lateral distance between tips of the combing tooth at each side of the central longitudinal plane may then be larger than the lateral distance between roots of the combing tooth. The tips of the combing tooth may be defined as the free end portions of the combing tooth, while the roots of the combing tooth may be defined as the opposite end portions of the combing tooth which are joined to the holder.

And likewise, may the hollow tooth also have portions such as the exterior combing structure, that are inclined relative to the central longitudinal plane. The lateral distance between tips of the exterior combing structure at each side of the central longitudinal plane may then be larger than the lateral distance between the roots of the exterior combing structure. The tips of the exterior combing structure may be defined as the free end portions of the hollow tooth, while the roots of the exterior combing structure may be defined as the opposite end portions of the hollow tooth which are joined to the holder.

To produce an optimized combing effect of the hairdressing device, the lateral distance between the tips of the exterior combing structure and the tips of combing teeth may be arranged essentially corresponding all along the central longitudinal plane L. Further, the lateral distance between the roots of the exterior combing structure and the roots of the combing teeth may essentially be arranged corresponding all along the central longitudinal plane L.

In an advantageous constructional outlay at least one of the channels of the hollow teeth has an inclined inner channel wall configured to define a first portion of the channel adjacent the air distribution chamber with a tapering shape. The tapering shape of the first channel portion is arranged for directing the air flow into a second portion of the channel, thereby leading the airflow out through the outlet opening(s). By this arrangement the air flow is directed effectively from the air distribution chamber and out through the outlet openings.

To enhance the drying effect on all hair strands in contact with and in proximity to the teeth of the hair dressing device, at least one air hole may be arranged through the wall of the holder in between the hollow teeth. The presence of one or plural holes, ensures that air is also distributed in the area of the combing teeth, thereby providing a drying effect on hair strands being located in between the hollow teeth.

The hairdressing device may be arranged with an attachment portion for connection to an apparatus suitable for supplying an air flow into the air distribution chamber such as for instance a hair dryer or other apparatus supplying an air flow capable of producing a drying effect.

The invention also includes a hairdressing apparatus which comprises a hairdressing device as defined herein. The hairdressing device may be releasably connected to the hairdressing apparatus, or the hairdressing device may be arranged as an integrated part of the hairdressing apparatus. In the first case the hairdressing device may be released and connected to the hairdressing apparatus according to need, and the hairdressing device may also be replaced by other suitable devices. In the latter case, the hairdressing device is permanently fixed to the hairdressing apparatus and has the function of a special purpose apparatus.

DETAILED DESCRIPTION OF THE INVENTION

In the following, the invention will be described in detail, with reference to the figures, wherein.

Figure 2:
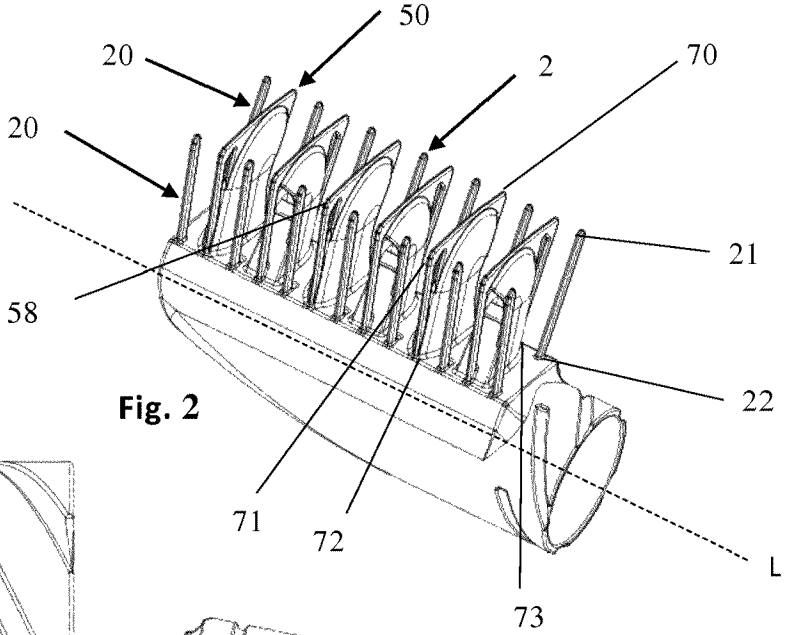
FIGS. 1-3 show, in various perspective views a first embodiment of the hair dresser device.

FIGS. 1-10 show the hairdressing device 1 in accordance with a first embodiment of the invention, and FIGS. 11-18 show a second embodiment of the hairdressing device. In the following the common features of the two embodiments of the hairdressing device 1 will be described and the specific features of the two embodiments will be pointed out. As seen in the figures, for instance FIGS. 1-4 and 11-14, a holder 2 is arranged with a plurality of combing teeth 20 and hollow teeth 50 extending from the holder 2. These combing teeth 20 and hollow teeth 50 constitute a combined drying and combing section. The holder 2 has an air distribution chamber 3, see for instance FIGS. 9, 10, 15 and 16. The holder 2 as illustrated in the figs has an attachment portion 10 for connection to an apparatus suitable for supplying an air flow into the air distribution chamber 3, for instance a hot air source, e.g., a blow-dryer, a hose with a nipple etc., from where the hot air is blown into the air distribution chamber 3. The hairdressing device 1 may also be integrated as a part of hairdressing apparatus, such as being a fixed part of the hairdressing apparatus, wherein hairdressing apparatus generates a flow of air, such as is known from present blow dryers.

Each hollow tooth 50 is configured with a channel 51 that in accordance with the first embodiment as shown in FIGS. 1-10 has an outlet opening 52 for the air to flow from the air distribution chamber 3 and out through the outlet opening 52, and according to the second embodiment the channel 51 has two outlet openings 52*a*, 52*b*, see FIGS. 11-15. The outlet openings 52 are oriented inclined relative to a central longitudinal plane L through the holder 2, and may as shown for instance in FIGS. 9 and 15 form an acute angle with the central longitudinal plane L. When in use the air flow as distributed through the channels 52 of the hollow teeth 50, will be directed away from the scalp and towards the hair to be dried and formed. The outlet openings 52, 52*a*, 52*b* are positioned in a distance above the tips 21 which are situated closest to the scalp and are inclined in a direction upward from the tips 55 of the teeth 50. The channel 51 has an inclined inner channel wall 80 forming a first portion of the channel 81 adjacent the air distribution chamber 3 with a tapering shape for direction of the air flow into a second portion of the channel leading the airflow out through the outlet opening(s) 52, 52*a*, 52*b*. Air holes 90 are arranged in between the hollow teeth 50 for supply of air also into the area of the combing teeth 20, wherein the air supply is to be directed in the extension direction of the combing teeth, perpendicular to the holder 2.

The hollow teeth 50 and the combing teeth 20 are positioned in an alternating pattern where a hollow tooth is placed next to a combing tooth. The hollow teeth 50 are configured for the air to flow out from outlet openings 52 at opposite sides A, B of a central longitudinal plane L through the holder 2. As the air flow is distributed symmetrically on both sides of the central longitudinal plane L, hairdressing device may easily be employed in most hand-held positions and combing directions and may be used equally by left and right-handed users.

In the first embodiment, see FIG. 1-10, the distribution of air flow through the hollow teeth 50 is carried out by every other hollow tooth 50 being turned oppositely to the next one, so that the outlet openings 52 of every other hollow tooth 50 is facing a diametrically opposite direction of the next hollow tooth, see for instance FIGS. 5-9.

By this alternating pattern of the hollow teeth 50, the air flow exits from every other hollow tooth at one side A of the central longitudinal plane and from the remaining hollow teeth at other side B of the central longitudinal plane. The hollow tooth has an exterior combing structure 58 surrounding the channel 51 and being positioned at both sides of the central longitudinal plane L so that a combing effect is also achieved by the hollow teeth 50. As seen the contours or exterior outlines of the exterior combing structures 58 match those of the combing teeth.

Figure 3:
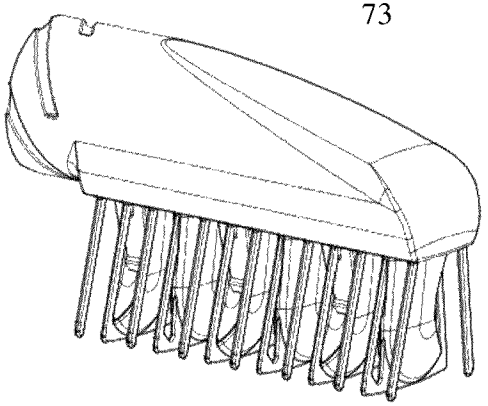
Figure 1:
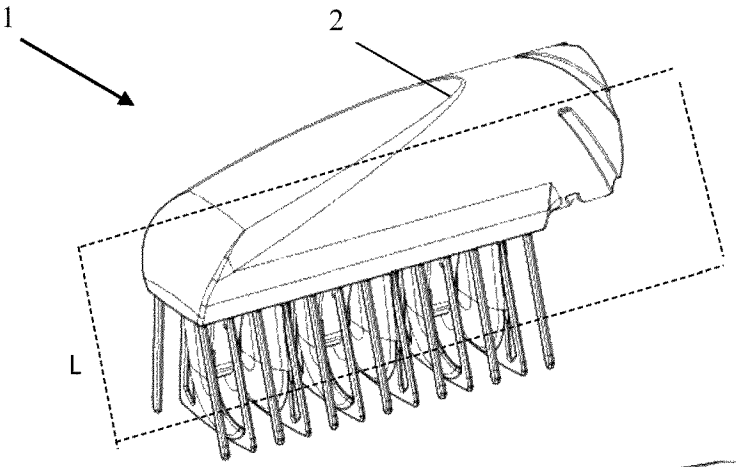
Figure 4:
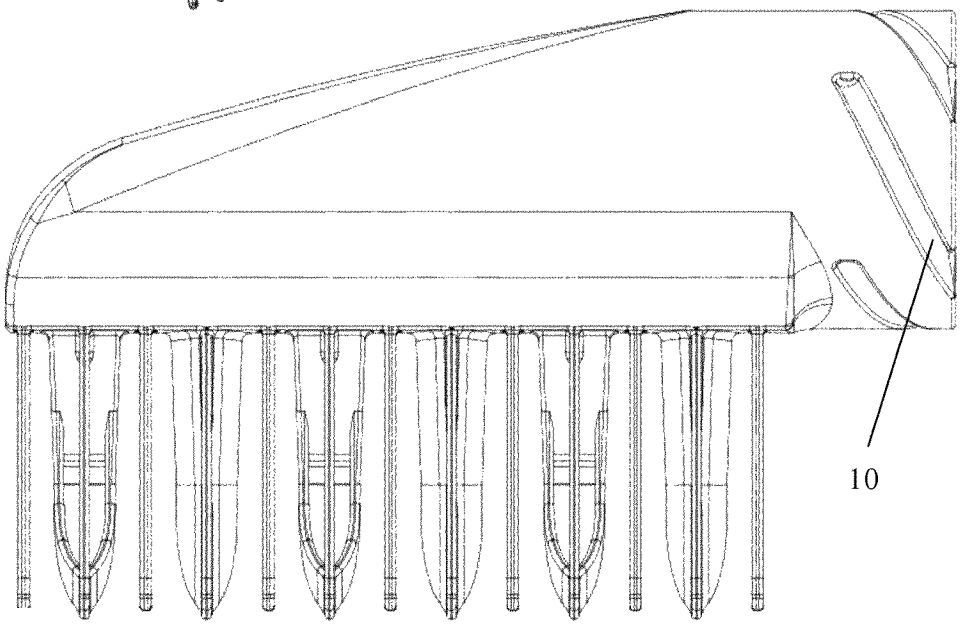
FIGS. 4-6 are longitudinal cross sections of the first embodiment of the hair dresser device as shown in FIGS. 1-3.
Figure 5:
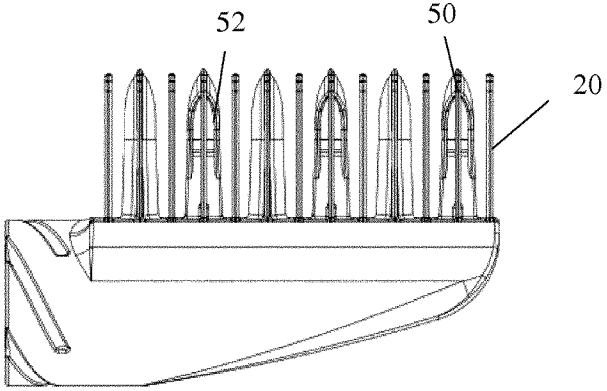
Figure 7:
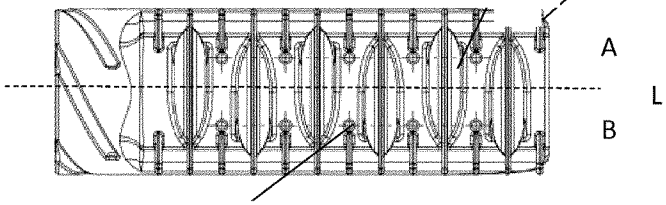
FIG. 7 is a bottom view of the first embodiment of the hair dresser device as shown in FIG. 6.
Figure 6:
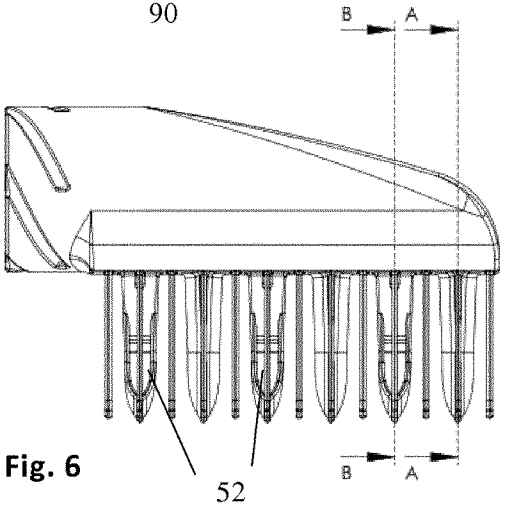
Figure 8:
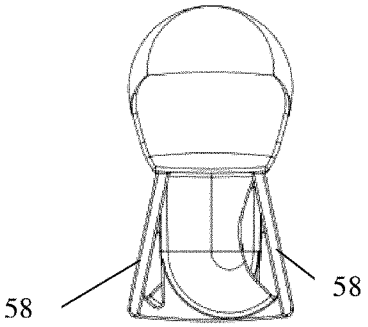
FIG. 8 is a front-end view of the first embodiment of the hair dresser device.
Figure 9:
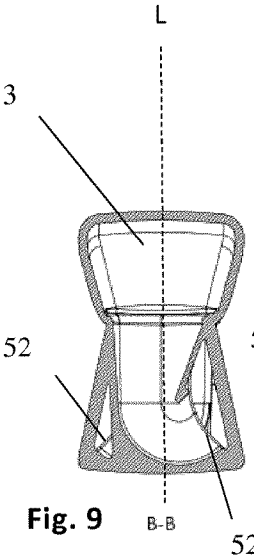
FIG. 9 and FIG. 10 are cross sections as illustrated in FIG. 6.
Figure 10:
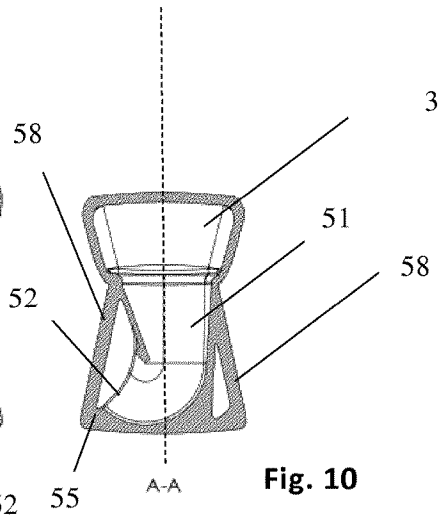

As seen for instance in FIGS. 1-3, the combing teeth 20 comprises two tooth sections positioned at equal distances form the central longitudinal plane L. The tooth sections are arranged with an inclined orientation so that the lateral distance between tips 21 of the pair of combing teeth 20 at each side of the central longitudinal plane L is larger than the lateral distance between roots 22 of the combing tooth. Likewise, the lateral distance between tips 70, 71 of the exterior combing structure 58 at each side of the central longitudinal plane L is larger than the lateral distance between roots 72, 73 of the exterior combing structure. As seen in the FIGS. 1-3, the lateral distances of the combing teeth 20 correspond to those of the hollow teeth 50, and thus the drying and combing zone of the hairdressing device 1 has a uniform appearance when moving in direction of the central longitudinal plane L.

Figure 12:
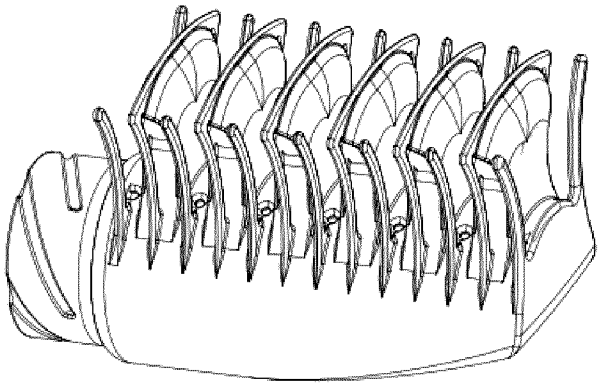
FIGS. 11-13 show in various perspective views a second embodiment of the hair dresser device.
Figure 11:
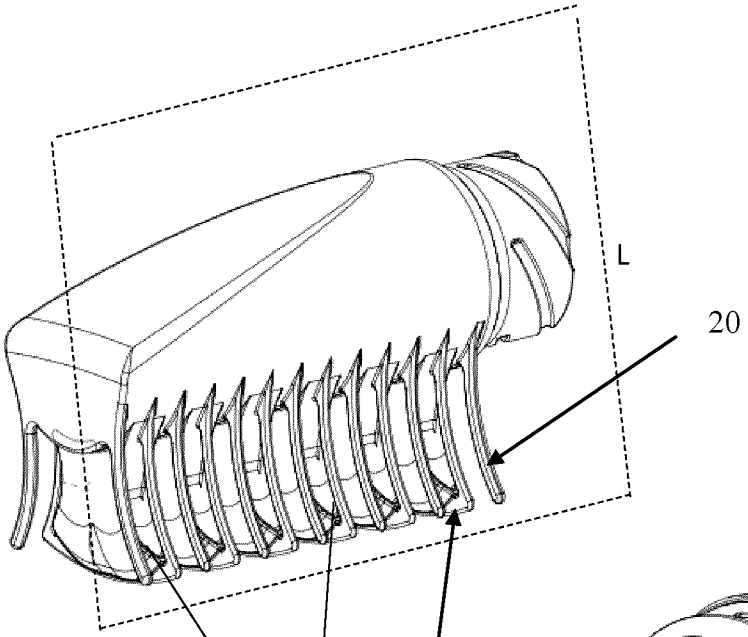
Figure 13:
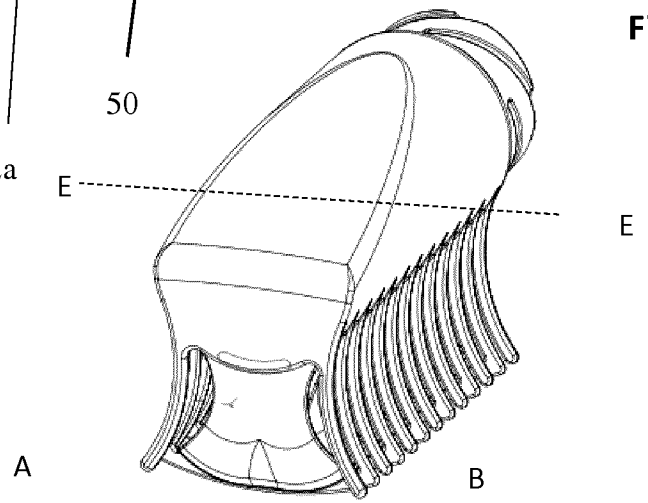
Figure 15:
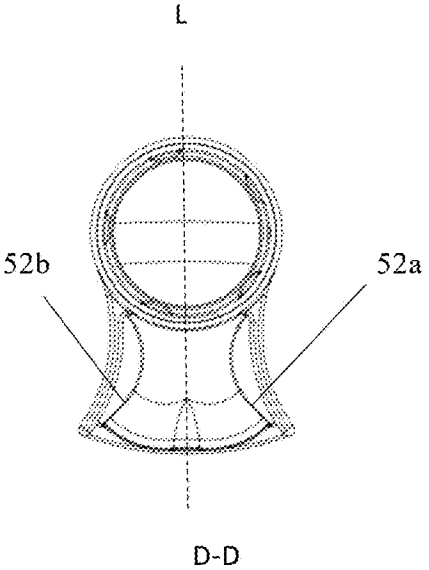
FIG. 15 is a cross section as illustrated in FIG. 14.
Figure 18:
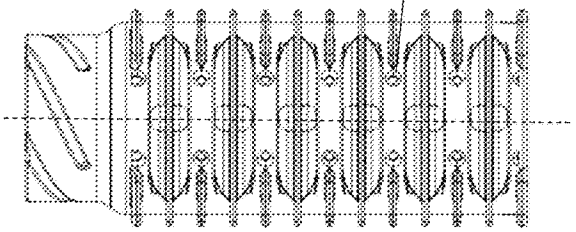
FIG. 18 is a bottom view of the hair dresser device as shown in FIG. 14.
Figure 14:
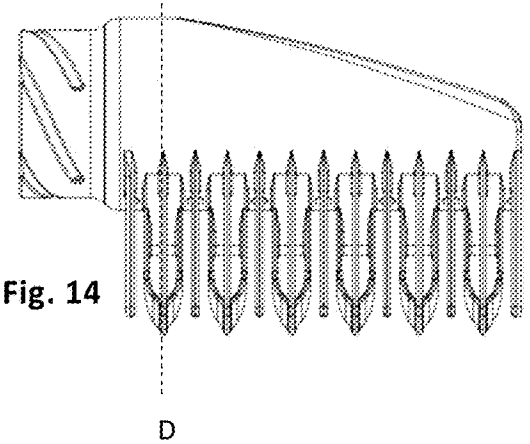
FIG. 14 is a longitudinal cross section of the second embodiment of the hair dresser device as shown in FIGS. 11-13.
Figure 16:
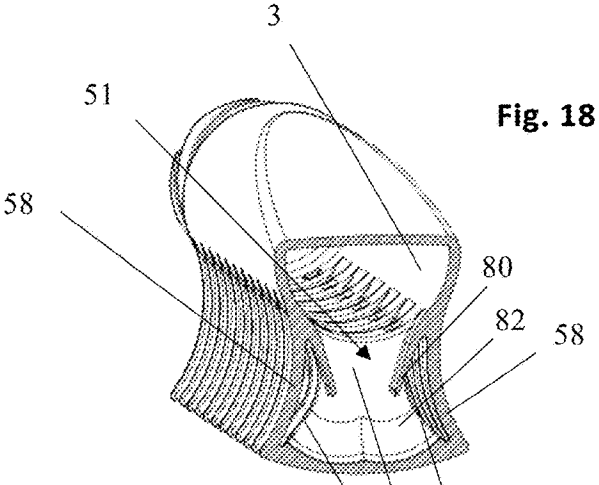
FIG. 16 is a cross section as illustrated in FIG. 13.
Figure 17:
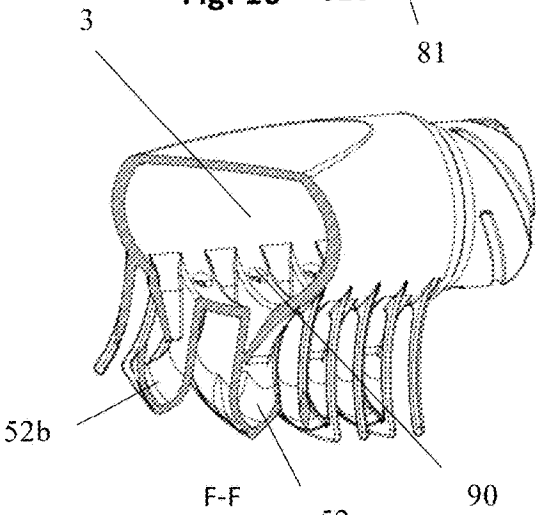
FIG. 17 is a cross section as illustrated in FIG. 11.

An alternative configuration of the hollow teeth 50 to direct the air to flow out from outlet openings 52 at opposite sides A, B of a central longitudinal plane L, is suggested in accordance with the second embodiment of the hairdressing device as shown in FIGS. 11-17. The channels 51 run from the air distribution chamber 3 and is separated into a first opening 52*a* and a second opening 52*b* facing the opposite sides A, B of the central longitudinal plane L. See FIGS. 15 and 16. These hollow teeth are also surrounded by external combing structures 58 and the dimensions and external shape of the hollow teeth 50 correspond to those of the combing teeth 20, thereby providing the hairdressing device 1 with an external shape that is similar to the first embodiment, is uniform along the central longitudinal plane L. The cross-section of the combing teeth 20 and the hollow teeth 50 as shown in first embodiment in FIGS. 1-10 is right-sided, whereas the cross sections of the external combing structures 58 and the combing teeth 20 show curved outer sides, as seen in FIGS. 11-13.

The invention claimed is:

1. Hairdressing device for shaping and drying hair, comprising a holder arranged with an air distribution chamber and arranged with a plurality of teeth projecting from the holder, each tooth of the plurality of teeth extending between a first end proximal to the holder and a second end distal to the holder, the plurality of teeth comprises combing teeth and hollow teeth, wherein each hollow tooth comprises a channel with at least one outlet opening for the air to flow from the air distribution chamber and exit through the at least one outlet opening, the hollow teeth are arranged with an exterior combing structure which is positioned at both sides of a central longitudinal plane and which has a configuration arranged to surround the channel, the combing teeth are positioned in an alternating pattern where a hollow tooth is placed next to a combing tooth, and the hollow teeth are configured for the air to flow out from outlet openings at opposite sides of a central longitudinal plane through the holder, wherein the combing teeth are arranged in pairs of teeth, each tooth of the respective pairs of teeth distanced at an equal lateral distance from the central longitudinal plane, the lateral distance between respective tips at the second end of each tooth of each pair of combing teeth at each side of the central longitudinal plane is larger than the lateral distance between respective roots at the first end of each tooth of each pair of combing teeth, the lateral distance between tips of the exterior combing structure at each side of the central longitudinal plane is larger than the lateral distance between roots of the exterior combing structure, the tips of the exterior combing structure being at the second end of the respective hollow tooth and the roots of the exterior combing structure being at the first end of the respective hollow tooth, the lateral distance between the tips of the exterior combing structure and the tips of the combing teeth is corresponding, and the lateral distance between the roots of the exterior combing structure and the roots of the combing teeth is corresponding all along the central longitudinal plane.

2. Hairdressing device in accordance with claim 1, wherein the hollow teeth are positioned in an alternating pattern where every other of the hollow teeth are configured for the outlet openings to exit the air flow at one side of the central longitudinal plane L and the remaining hollow teeth are configured for the outlet openings to exit the air flow at other side of the central longitudinal plane L.

3. Hairdressing device in accordance with claim 1, wherein at least one of the channels of the hollow teeth comprises two outlet openings: a first outlet opening and a second outlet opening, wherein the first outlet opening and the second outlet opening faces opposite sides of the central longitudinal plane.

4. Hairdressing device in accordance with claim 1, wherein the at least one of the outlet openings of the hollow teeth have an inclined orientation, positioning at least part of the plane of the outlet openings at a predetermined acute angle with the central longitudinal plane, for the air flow to be directed away from the hair scalp.

5. Hairdressing device in accordance with claim 1, wherein the at least one of the channels of the hollow teeth has an inclined inner channel wall configured to define a first a portion of the channel-adjacent the air distribution chamber with a tapering shape for direction of the air flow into a second portion of the channel leading the airflow out through the outlet opening.

6. Hairdressing device in accordance with claim 1, wherein at least one air hole is arranged through the wall of holder in between the hollow teeth.

7. Hairdressing device in accordance with claim 1 wherein the hairdressing device has an attachment portion for connection to an apparatus suitable for supplying an air flow into the air distribution chamber.

8. Hairdressing apparatus comprising a hairdressing device for shaping and drying hair, comprising a holder arranged with an air distribution chamber and arranged with a plurality of teeth projecting from the holder, each tooth of the plurality of teeth extending between a first end proximal to the holder and a second end distal to the holder, the plurality of teeth comprises combing teeth and hollow teeth, wherein each hollow tooth comprises a channel with at least one outlet opening for the air to flow from the air distribution chamber and exit through the at least one outlet opening, the hollow teeth are arranged with an exterior combing structure which is positioned at both sides of a central longitudinal plane and which has a configuration arranged to surround the channel, the combing teeth are positioned in an alternating pattern where a hollow tooth is placed next to a combing tooth, and the hollow teeth are configured for the air to flow out from outlet openings at opposite sides of a central longitudinal plane through the holder, wherein the combing teeth are arranged in pairs of teeth, each tooth of each respective pair of teeth distanced at an equal lateral distance from the central longitudinal plane, the lateral distance between respective tips at the second end of each tooth of each pair of combing teeth at each side of the central longitudinal plane is larger than the lateral distance between respective roots at the first end of each tooth of each pair of combing teeth, the lateral distance between tips of the exterior combing structure at each side of the central longitudinal plane is larger than the lateral distance between roots of the exterior combing structure, the tips of the exterior combing structure being at the second end of the respective hollow tooth and the roots of the exterior combing structure being at the first end of the respective hollow tooth, the lateral distance between the tips of the exterior combing structure and the tips of the combing teeth is corresponding, and the lateral distance between the roots of the exterior combing structure and the roots of the combing teeth is corresponding all along the central longitudinal plane.

* * * * *